US007242264B1

(12) United States Patent
How

(10) Patent No.: US 7,242,264 B1
(45) Date of Patent: Jul. 10, 2007

(54) METHOD AND APPARATUS OF OBTAINING BROADBAND CIRCULATOR/ISOLATOR OPERATION BY SHAPING THE BIAS MAGNETIC FIELD

(76) Inventor: Hoton How, 262 Clifton St., Belmont, MA (US) 02478

( * ) Notice: Subject to any disclaimer, the term of this patent is extended or adjusted under 35 U.S.C. 154(b) by 212 days.

(21) Appl. No.: 11/110,073

(22) Filed: Apr. 21, 2005

(51) Int. Cl.
*H01P 1/387* (2006.01)

(52) U.S. Cl. ..... 333/1.1; 333/24.2

(58) Field of Classification Search ..... 333/1.1, 333/24.2
See application file for complete search history.

(56) References Cited

U.S. PATENT DOCUMENTS 6,317,010 B1 * 11/2001 Butland et al. ..... 333/1.1
* cited by examiner

*Primary Examiner*—Stephen E. Jones

(57) ABSTRACT

Disclosed is one method and one apparatus which teach improved techniques in using a shaped bias magnetic field over the active region of a ferrite stripline circulator/isolator circuit. The axial component of the bias field is decreased from the center toward edge, thus it is able to accommodate the accompanying changes in magnetization. This fulfills the requirements that frequencies are scaled with distances thereby warranting broadband operation. Furthermore, the radial component of the bias field is reduced, so as to minimize the generation of non-circulation volume modes. The discontinuity in magnetization distributed over the circulator/isolator active region is reduced, so as to minimize the generation of magnetostatic surface modes. The resultant circulator/isolator performance can thus show a broad bandwidth with improved characteristics in insertion loss and in isolation.

18 Claims, 13 Drawing Sheets

PRIOR ART:
Edge-Mode Isolator
(Hines, 1961)

Edge-Mode/Displacement Mode
Propagates along Forward Direction

Non-Reciprocal
Wave-Propagation

Edge-Mode/Displacement Mode
Dissipates along Backward Direction

METHOD AND APPARATUS OF OBTAINING BROADBAND CIRCULATOR/ISOLATOR OPERATION BY SHAPING THE BIAS MAGNETIC FIELD

CROSS REFERENCE TO RELATED APPLICATIONS (Not Applicable)

FEDERALLY SPONSORED RESEARCH (Not Applicable)

SEQUENCE LISTING OR PROGRAM (Not Applicable)

BACKGROUND OF INVENTION

1. Field of Invention

This invention is directed to one method and one apparatus to obtain broadband operation of a ferrite stripline edge-mode/standing-mode circulator/isolator. More specifically, this invention teaches to use a varying magnetic bias to broaden the transmission band of a ferrite stripline edge-mode/standing-mode circulator/isolator with improved characteristics.

2. Prior Art

Although ferrite stripline junction circulators have been described in the literature since the 1950's, their operation was only vaguely understood until the theoretical work by Bosma in 1964 (H. Bosma, "On stripline Y-circulation at UHF," IEEE Microwave Theory Tech., vol. MTT-12, pp. 61-73, January 1964), and by Fay and Comstock in 1965 (C. E. Fay and R. L. Comstock, "Operation of the ferrite junction circulator," IEEE Trans. Microwave Theory Tech., vol. MTT-13, pp. 15-27, January 1965). The operation of an edge-mode ferrite isolator was described by Hines in 1961 (M. E. Hines, "Reciprocal and Nonreciprocal Modes of Propagation in Ferrite Stripline and Microstrip Devices", IEEE Trans. vol. MTT-19, pp. 442-451, 1961), and an edge-mode ferrite circulator by How in 2005 (H. How, "Magnetic Microwave Devices," in Encyclopedia of RF and Microwave Engineering, Vol. 3, pp. 2425-2461, 2005). Since then, the prior art has always assumed that a ferrite circulator or isolator is operational under a magnetic bias field established via the use of permanent magnets whose explicit spatial profile is considered immaterial to the circuit performance, at least deemed not critical. The resultant frequency bandwidth is thus restricted to a 2:1 ratio (Y. S. Wu and F. J. Rosenbaum, "Wide-band operation of microstrip circulators," IEEE Trans. Microwave Theory Tech., vol. MTT-22, pp. 849-856, October 1974), or a 3:1 ratio (M. G. Mathew and T. J. Weisz, "Microwave Transmission Devices Comprising Gyromagnetic Material Having Smoothly Varying Saturation Magnetization," U.S. Pat. No. 4,390,853, Jun. 28, 1983).

There has been rapid development in RF and microwave technologies during the past decade. RF and microwave wireless applications have been and continue to be among the fastest growth areas. Some of the expanding activities in these fields include wireless communications (mobile, cellular, and satellite), wireless sensors, local area networks, remote control and identification, global positioning systems (GPS), and intelligent highway and vehicle systems (IHVS). Circulators and isolators are indispensable building elements in RF and microwave circuits: they are used whenever isolation is intended among circuit modules, separating the signal paths according to their propagation directions thereby allowing the transmitter and the receiver to multiplex. Also, broadband instrumentations are needed by the electronic testing industries so that universal equipments are possible whose operation is independent of frequency. As the market is always hungry for bandwidths, the need for broadband circulators and isolators with improved transmission characteristics is thus clear and evident.

3. Objects and Advantages

Accordingly, it is an object of the invention to address one or more of the foregoing disadvantages or drawbacks of the prior art, and to provide such an improved method and apparatus to obtain improved broadband circulator/isolator operation by properly shaping the bias magnetic field. The bias magnetic field is thus shaped not only to satisfy the necessary circulation conditions for the circulator or isolator circuit, but also to partially magnetize the ferrite material thereby forming a gradual transition to warrant broadband operation; the radial component is reduced and discontinuity in magnetization is minimized, resulting in improved characteristics of the circulator or isolator performance.

Other objects will be apparent to one of ordinary skill, in light of the following disclosure, including the claims.

SUMMARY

In one aspect, the invention provides a method which allows the bias magnetic field expressed onto the circulator/isolator active region to be properly shaped to result a broad transmission band on one hand and improved performance characteristics on the other hand. The circulator/isolator circuit comprises of a ferrite junction exciting resonant standing modes invoking the frequency tracking condition, or the edge-mode operation is involved exploiting wave overlap at the adjacent ports. The radial component of the bias field is reduced so as to inhibit the excitation of non-circulation volume modes, and the discontinuity in magnetization is minimized at the edge so as to suppress the excitation of magnetostatic surface modes. This implies improved performance in isolation and in insertion loss of the circulator/isolator device.

In another aspect, the invention provides an apparatus which endows a mechanism enabling the bias magnetic field expressed onto the active region of a ferrite stripline circulator/isolator circuit to be adequately adjusted or tailored thereby to result broadband operation with improved performance characteristics. The mechanism includes field condenser means which are effective to gradually reduce the axial field intensity from the center to the edge. Or, the mechanism adopts the use of tapered magnets generating weaker fields at the edge than at the center, or both.

DRAWINGS

Figure

For a more complete understanding of the nature and objectives of the present invention, reference is to be made to the following detailed description and accompanying drawings, which, though not to scale, illustrate the principles of the invention, and in which.

Figure 10:
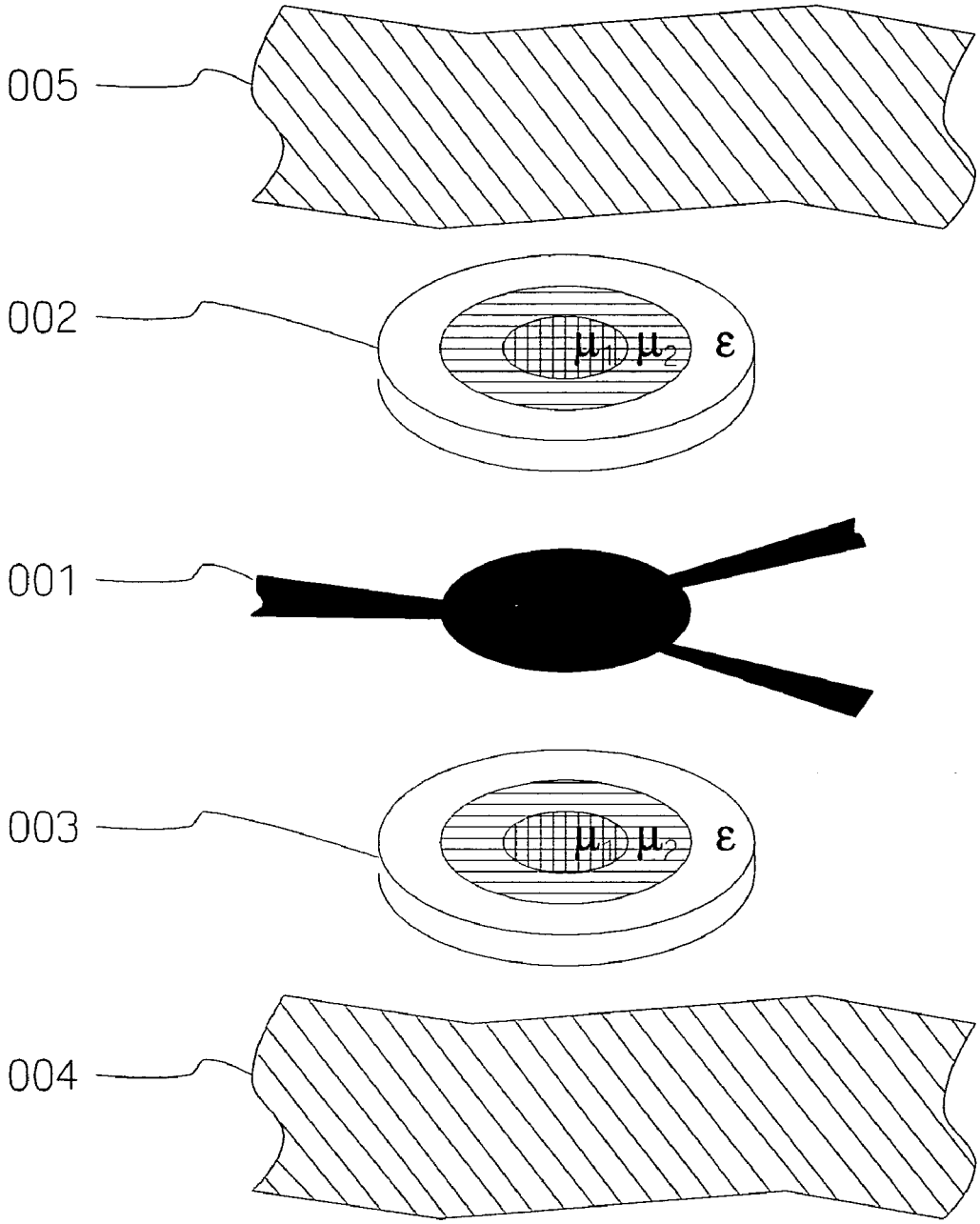

FIG. 10 shows another example of the preferred embodiment of the invention that the ferrite stripline circulator/isolator circuit consists of 3 joining ports sandwiched between composite dielectric/ferrite superstrate and substrate assuming the disk/ring geometry covered by ground planes at top and bottom; impedance transformers are also shown and the circuit is devised for the edge-mode operation.

Figure 11:
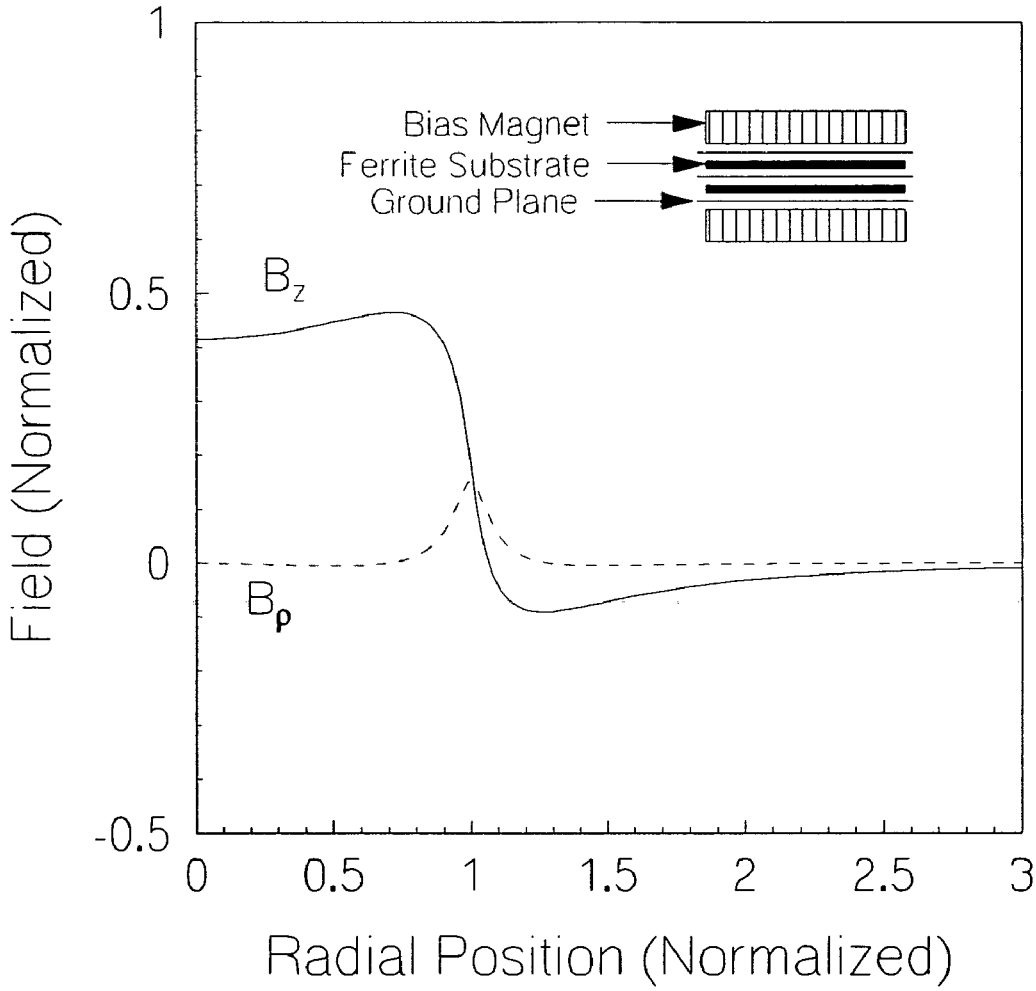

FIG. 11 shows one example of calculations that the axial and the radial magnetic fields generated by a pair of permanent magnets are plotted as a function of distance along the radial direction and the bias field is subject to no field shaping without employing flux shielding.

Figure 12:
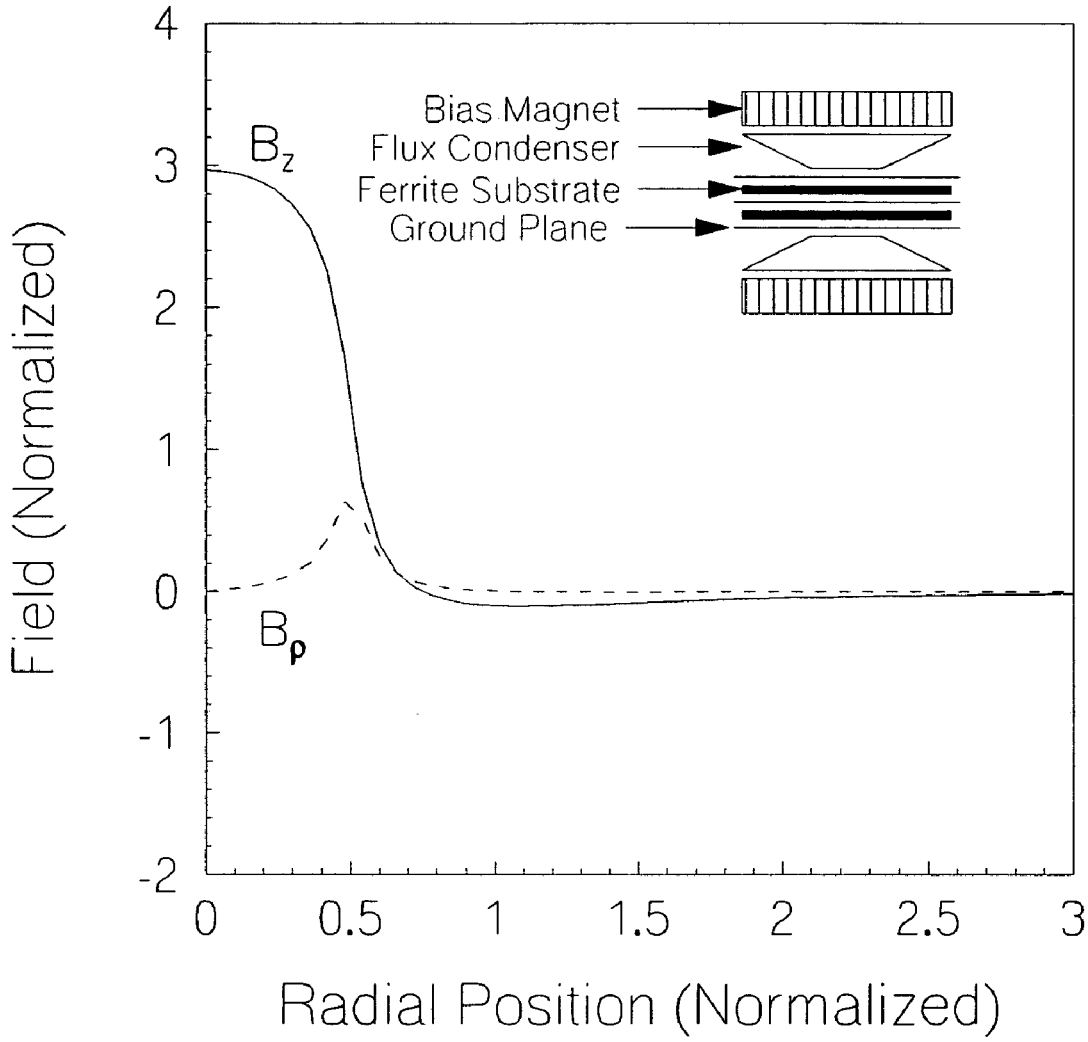

FIG. 12 shows another example of calculations that the axial and the radial magnetic fields generated by a pair of permanent magnets are plotted as a function of distance along the radial direction and the bias field is subject to field shaping via the use of a pair of condenser caps without employing flux shielding.

Figure 13:
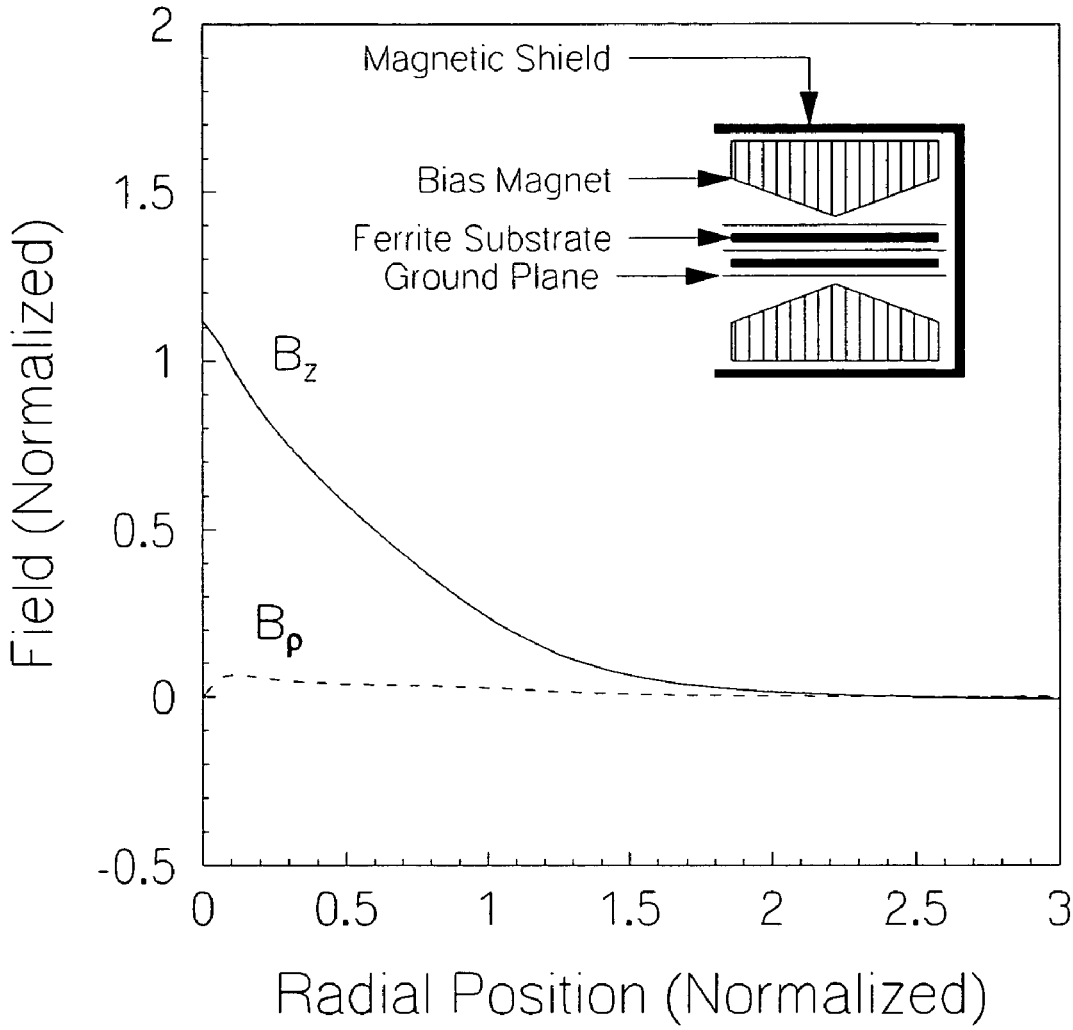

FIG. 13 shows another example of calculations that the axial and the radial magnetic fields generated by a pair of tapered permanent magnets are plotted as a function of distance along the radial direction and the bias field is subject to flux shielding.

REFERENCES NUMERALS

| | |
|---|---|
| 001 | Central Conductor |
| 002 | Superstrate |
| 003 | Substrate |
| 004, 005 | Ground Plane |
| 011, 012, 013, 014, 015, 016, 017, 018 | Magnet |
| 021, 022 | Condenser Cap |
| 023, 024, 025, 026, 027, 028 | Condenser Disk |
| 090 | Flux Shield |

DETAILED DESCRIPTION

Figure 1:
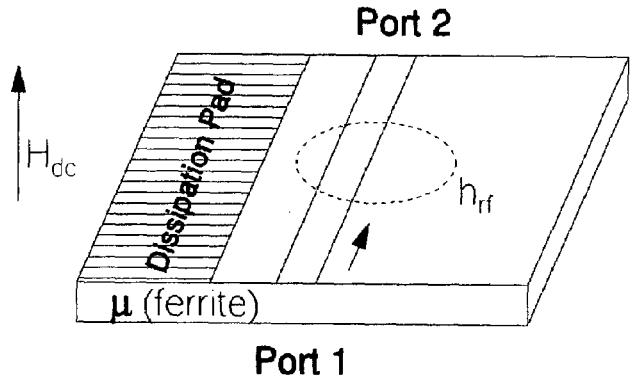
FIG. 1 shows the prior art that a ferrite edge-mode isolator is operating admitting nonreciprocal wave propagation for broadband transmission.
Figure 1:
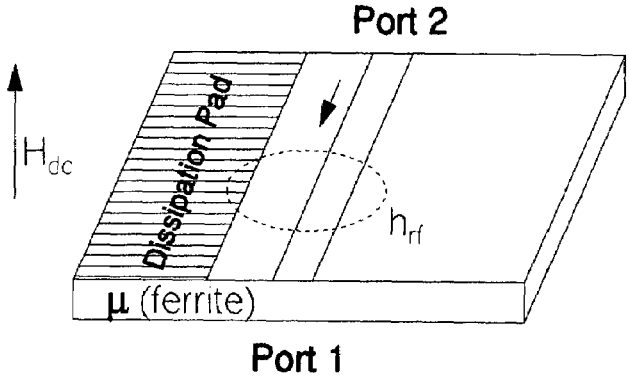
Figure 2:
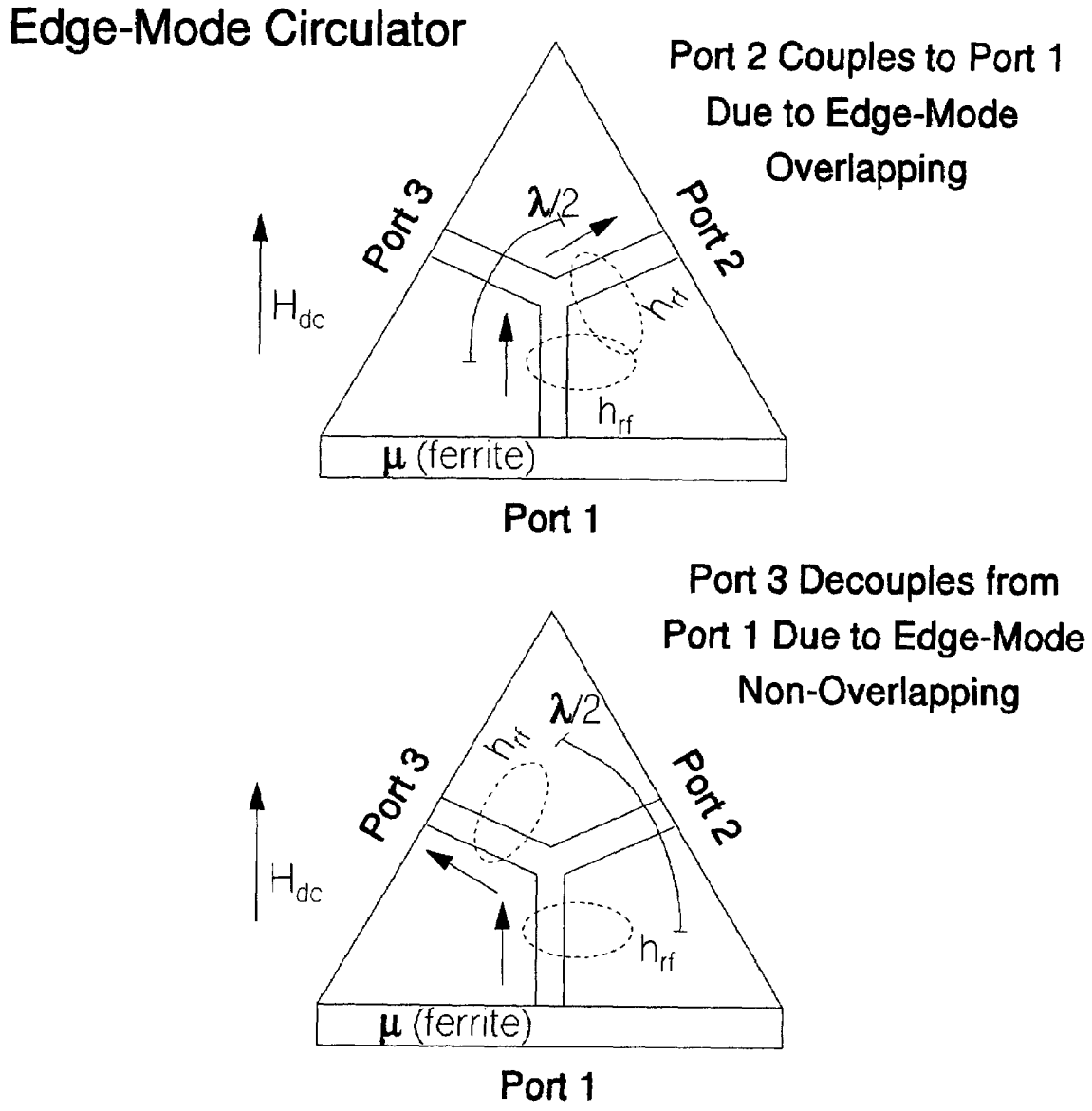
FIG. 2 shows the prior art that a ferrite edge-mode circulator is operating admitting nonreciprocal wave propagation for broadband transmission.

Background and Rationale:—FIG. 1, FIG. 2

Broadband 2-port isolators using the traveling displacement modes or edge modes were first reported by Hines in 1961. In FIG. 1 a stripline is fabricated on top of a ferrite substrate and an dissipation pad, such as a thin layer of poor conductor, is deposited at one side of the substrate next to the stripline circuit. The superstrate, which consists of the same ferrite material, stacks above the substrate, and ground planes are attached to the substrate and superstrate at their outer surfaces. Superstrate and ground planes are not shown in FIG. 1. In the presence of a vertically applied bias magnetic field wave propagation long the stripline is nonreciprocal, to be highly transmitting along one direction, but highly attenuating along the other direction. That is, the RF-magnetic field pattern shown as dashed curves in FIG. 1 displaces toward the edge of the stripline in the presence of the bias magnetic field, which is either shifting away from the dissipation pad, top drawing, or onto the dissipation pad, bottom drawing, resulting in little attenuation, or heavy attenuation, respectively. Hynes has shown the operation of an edge-mode isolator provided a 3:1 transmission band, which is about the same bandwidth reported by Mathew and Weisz in 1983 utilizing a circulator junction with varying magnetization.

Edge-mode traveling-wave operation can also be realized by the 3-port junction geometry, as suggested by How in 2005. In FIG. 2, 3 joining ports exhibiting a 3-fold symmetry rather than 2 aligning ports are shown depositing on top of a triangularly shaped ferrite substrate. Again, a similar superstrate covers the substrate on top and two ground planes are applied at their respective outer surfaces. Superstrate and ground planes are not shown in FIG. 2. To operate a bias magnetic field is applied along the junction-thickness direction launching the displacement modes or the edge modes to travel, in a manner analogous to the Hines' isolator modes shown in FIG. 1. As a consequence, edge modes couple strongly from ports 1 to 2, due to overlap of waves with phase coherency, but decouples strongly from ports 1 to 3 in lack of the required wave overlap. This results in the desired circulator operation that electromagnetic waves entering port 1 can only exit from port 2, from port 2 to port 3, and from port 3 to port 1, but not the other way around. As such, FIG. 2 does not need a dissipation pad, as in contrast to the isolator circuit shown in FIG. 1. In FIG. 2 the dashed curves depict schematically the RF magnetic field patterns illustrating the coupling and decoupling situations for wave propagation in ports. More circulator ports other than 3 can be equally assumed in FIG. 2.

In order to widen the transmission band of an edge-mode circulator it is necessary to enforce phase coherency for wave propagation between the input and the output ports across a broad frequency range. That is, phase coherency needs to be maintained over one half the wavelength distance, which is denoted as $\lambda/2$ in FIG. 2. Therefore, high frequency signals couple mostly strongly near the center of the circuit, and low frequency signals couple most strongly near the edge of the circuit. Since the operation of a ferrite device requires the magnetization to scale with frequency, which is known as gyromagnetic ratio, one expects a broadband edge-mode circulator to result if the circulator circuit shows different magnetizations to be scaled with the propagation wavelengths, to be large at the center, but small at the edge. In addition, the internal magnetic field needs also to scale along distance, so as to follow and track the circulation condition over frequencies. This means that the bias field needs to be reduced in accordance with the magnetization change from the center of the circulator circuit toward edge.

The other advantage of reducing the magnetization and the internal field to nearly zero at the edge of a circulator circuit is to suppress magnetostatic surface waves (MSWs). MSWs are excited near the edge of a circulator circuit whenever there exists discontinuities in magnetization. MSWs are manifested as leaky waves whose presence can degrade significantly the isolation and insertion-loss performance of the circuit. Performance degradation can also result if non-circulation volume modes are excited within the active region of the circulator circuit due to the non-vanishing radial component of the bias magnetic field; only the axial component of the bias field is responsible for the circulation operation. Radial field appears mostly at the edge of a circulator circuit, which can be minimized if the bias field is all reduced near the edge of the circuit. Although the above discussion is made with the edge-mode circulator shown in FIG. 2, it can also be applied to the resonant modes or the standing modes excited with a ferrite circulator junction incorporating the frequency-tracking condition introduced by Wu and Rosenbaum in 1974. Since an isolator circuit can be derived from a circulator circuit by connecting the irrelevant ports with dummy loads, the following discussions concern only the circulator circuits.

Preferred Embodiments of the Present Invention:—FIG. 3, FIG. 4, FIG. 5, FIG. 6

Figure 3:
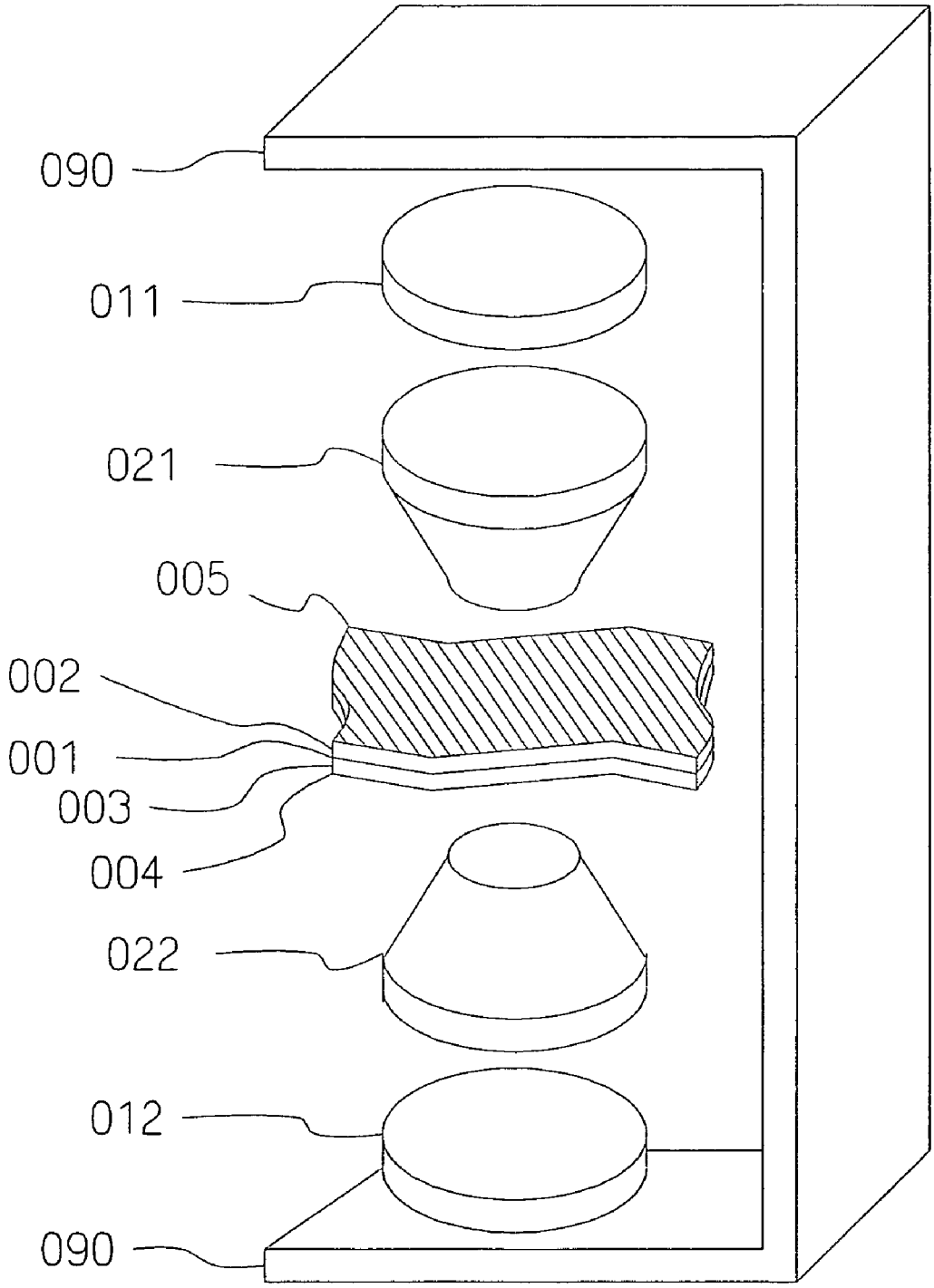
FIG. 3 shows one example of the preferred embodiment of the invention that a ferrite stripline circulator/isolator circuit is biased by two permanent magnets in conjunction with a pair of flux condenser caps to properly shape the bias field in the active region.

To illustrate the present invention explicit examples are given in FIG. 3, FIG. 4, FIG. 5, FIG. 6, which are all effective in shaping the bias magnetic field in the active region of a ferrite stripline circulator. In FIG. 3, FIG. 4, FIG. 5, FIG. 6 a ferrite stripline circulator circuit is defined by Central Conductor 001 sandwiched between Superstrate 002 and Substrate 003 with Ground Plane 004 and 005 attached at respective outer surfaces from top and below. Explicit examples of ferrite stripline circulator circuits are shown in FIG. 7, FIG. 8, FIG. 9, FIG. 10 which will be discussed in the next section. In FIG. 3, FIG. 4, FIG. 5, FIG. 6 the bias magnetic field is generated by Magnet 011 and 012 and Flux Shield 090 is enclosed at outside providing the return path for the generated magnetic fluxes. In FIG. 3 Condenser Cap 021 and 022 are used, inserted between Magnet 011 and 012 below and above the active region of the ferrite stripline circulator circuit. Condenser Cap 021 and 022 are made of soft magnetic materials showing a high magnetic permeability serving as a low magnetic-reluctance path for magnetic fluxes. As such, magnetic fluxes are attracted and condensed near the center of the active region of the ferrite stripline circulator circuit thereby being able to effectively shape the bias magnetic field therein.

Figure 4:
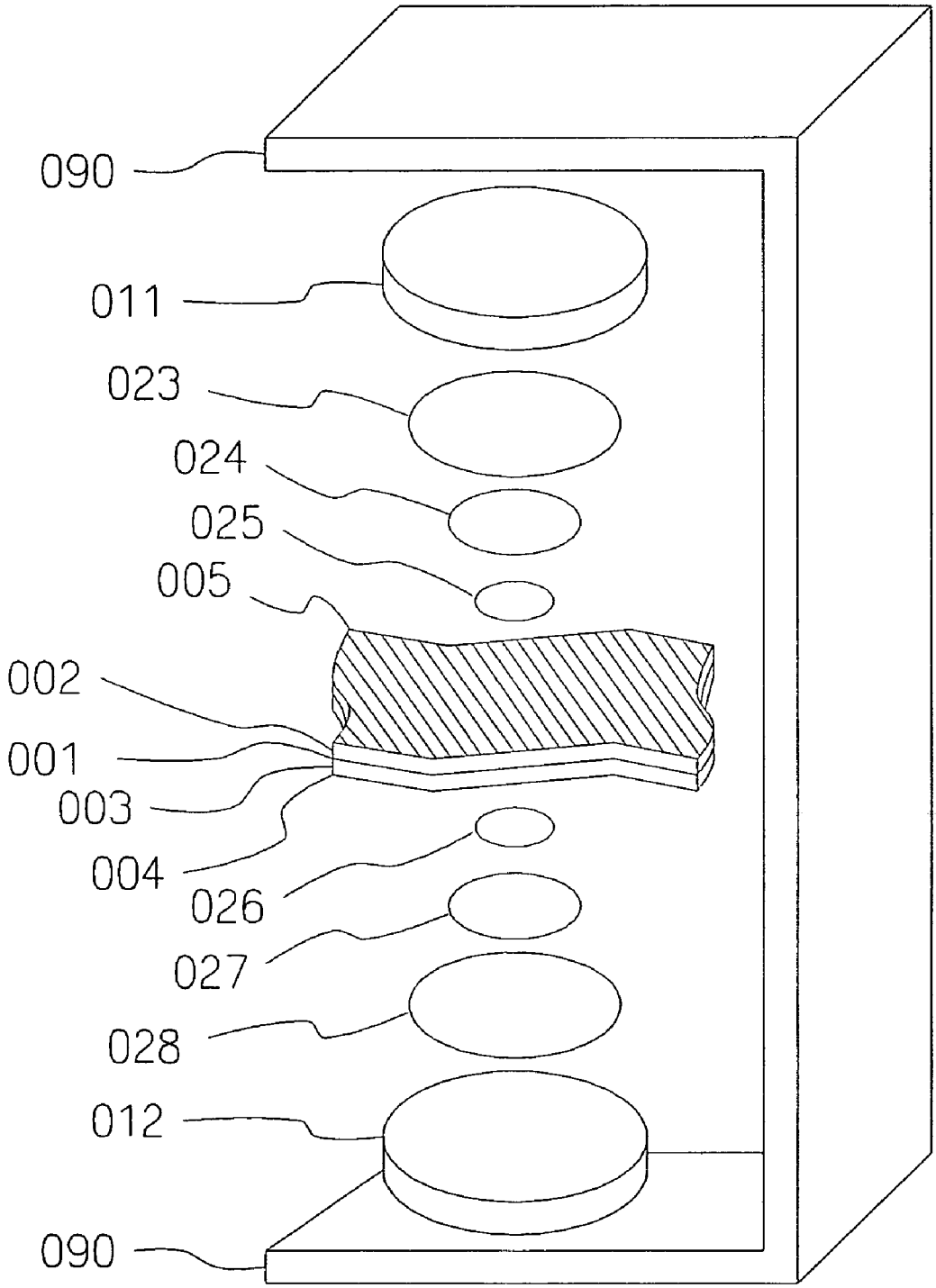
FIG. 4 shows another example of the preferred embodiment of the invention that a ferrite stripline circulator/isolator circuit is biased by two permanent magnets in conjunction with 3 pairs of flux condenser disks to properly shape the bias field in the active region.
Figure 5:
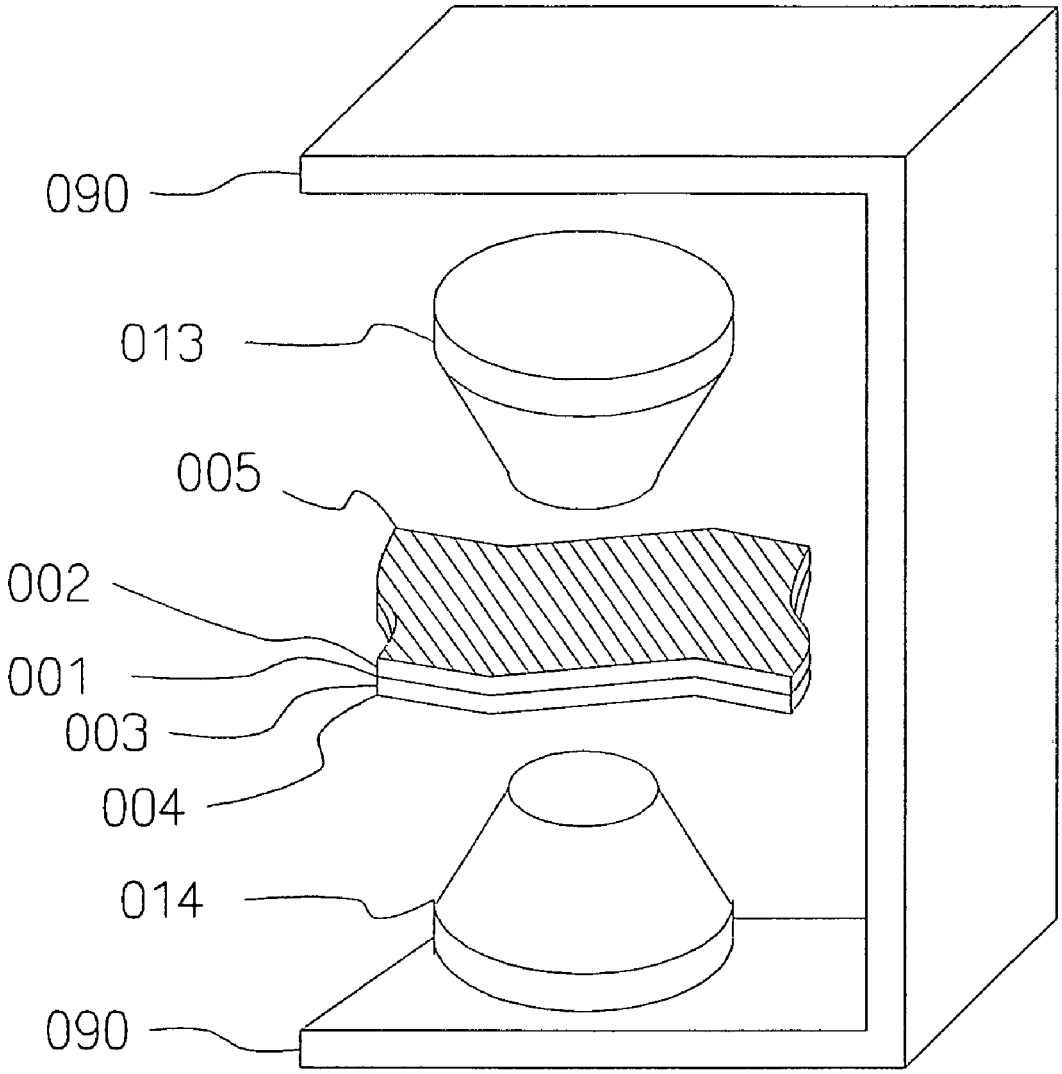
FIG. 5 shows another example of the preferred embodiment of the invention that a ferrite stripline circulator/isolator circuit is biased by two permanent magnets whose shapes show a tapered geometry to generate a bias field with an adequate profile in the active region.
Figure 6:
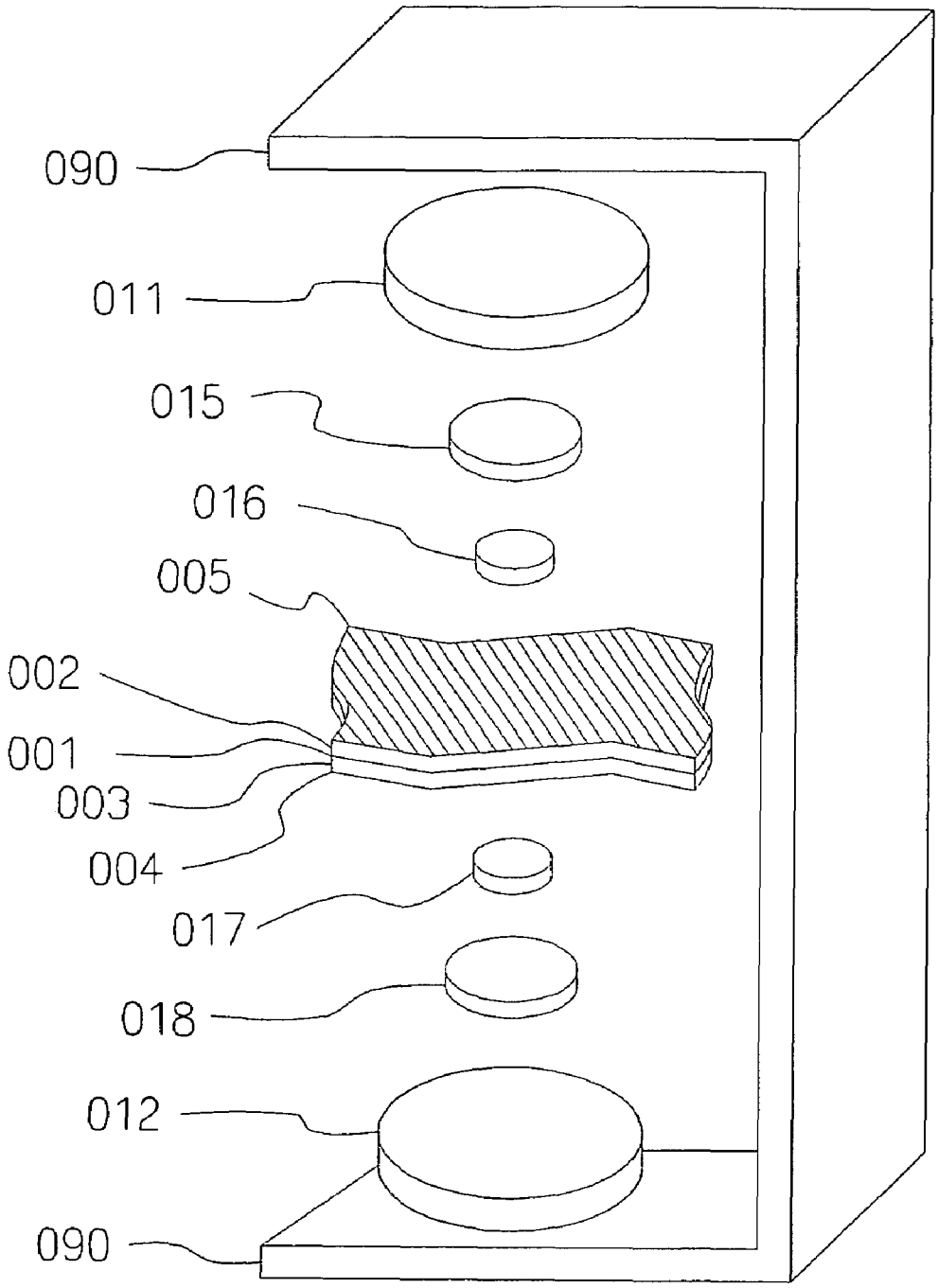
FIG. 6 shows another example of the preferred embodiment of the invention that a ferrite stripline circulator/isolator circuit is biased by 3 pairs of permanent magnets with decreasing diameters to jointly generate a bias field with an adequate profile in the active region.

Condenser Cap 021 and 022 in FIG. 3 may be sliced into thin disks with shrinking diameters, as shown by Condenser Disk 023, 024, 025, 026, 027, 028 in FIG. 4. Condenser Cap 021 and 022 in FIG. 3 and Condenser Disk 023, 024, 025, 026, 027, 028 in FIG. 4 can be made of a magnetic metal such as iron, nickel, cobalt, or their alloys. Alternatively, magnetic shaping can be realized via the use of shaped magnets. This is shown in FIG. 5 where Magnet 013 and 014 are shaped into (truncated) circular cones capable of generating more magnetic fluxes at the center than at the edge of the ferrite stripline circulator circuit. Magnet 013 and 014 in FIG. 5 can be sliced into disks with shrinking diameters, as shown by Magnet 015, 016, 017, 018 in FIG. 6. Typical magnetic profiles appearing in the active region of the circulator circuit shown with FIG. 3, FIG. 4, FIG. 5, FIG. 6 have been calculated, as shown by FIG. 11, FIG. 12, FIG. 13 to be discussed shortly. Note that Magnet 011, 012, 013, 014, 015, 016, 017, 018, Condenser Cap 021 and 022, and Condenser Disks 023, 024, 025, 026, 027, 028 shown in FIG. 3, FIG. 4, FIG. 5, FIG. 6 have assumed the circular symmetry, and it is not necessary. For example, the 3-fold or 6-fold symmetry can be assumed and Magnet 011, 012, 013, 014, 015, 016, 017, 018, Condenser Cap 021 and 022, and Condenser Disk 023, 024, 025, 026, 027, 028 shown in FIG. 3, FIG. 4, FIG. 5, FIG. 6 can be shaped into (truncated) prismatic or hexagonal cones to effectively shape the magnetic field to achieve the intended operation of the ferrite stripline circulator.

Further Illustration of the Present Invention:—FIG. 7, FIG. 8, FIG. 9, FIG. 10

Figure 7:
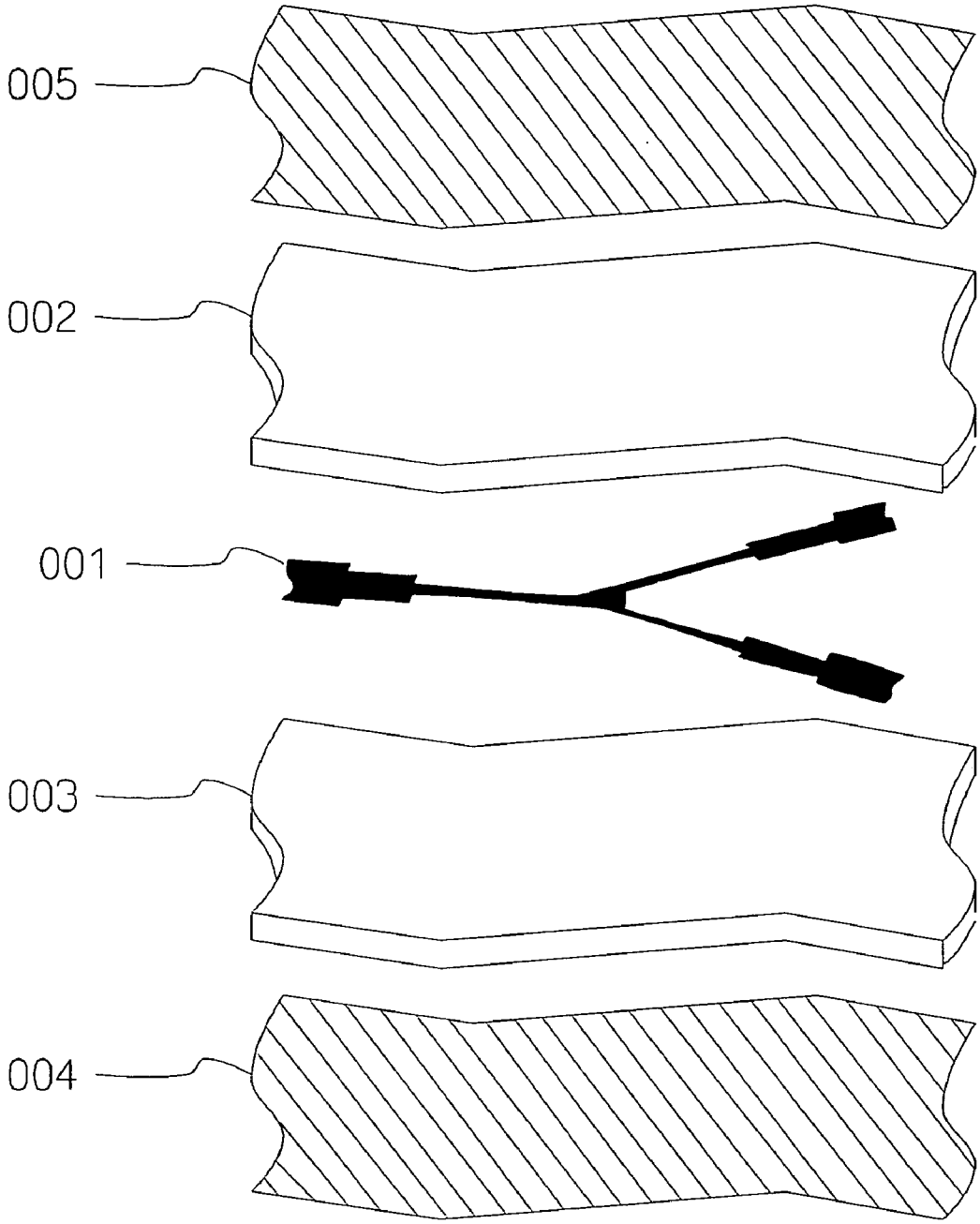
FIG. 7 shows one example of the preferred embodiment of the invention that the ferrite stripline circulator/isolator circuit consists of 3 joining ports sandwiched between a ferrite superstrate and a ferrite substrate covered by ground planes at top and bottom; impedance transformers are also shown and the circuit is devised for the edge-mode operation.

FIG. 7, FIG. 8, FIG. 9, FIG. 10 show further illustrations of the preferred embodiments of the present invention disclosed with FIG. 3, FIG. 4, FIG. 5, FIG. 6. That is, Central Conductor 001, Superstrate 002, Substrate 003, Ground Plane 004 and 005 shown in FIG. 3, FIG. 4, FIG. 5, FIG. 6 are expanded to show the explicit the ferrite stripline circulator circuit. In FIG. 7 Superstrate 002 and Substrate 003 are two pieces of ferrite slabs enclosing Central Conductor 001 from top and below, and Central Conductor 001 is shown as a Y-branch with 3 joining ports. Transformer sections are included with the ports so as to match the impedance differences for broadband operation. In the presence of a non-uniform magnetic bias field the induced magnetization within the ferrite materials needs not to be uniform. That is, when a varying bias magnetic field is impressed with a maximum intensity at center vanishing at edge, Superstrate 002 and Substrate 003 are magnetized accordingly so that maximum magnetization is attained at the center of the circulator circuit, decreasing gradually to zero at the edge. In other words, Superstrate 002 and Substrate 003 need not to be fully magnetized to perform the broadband operation, and the vanishing magnetization at the circulator edge assures minimum generation of MSWs.

Figure 8:
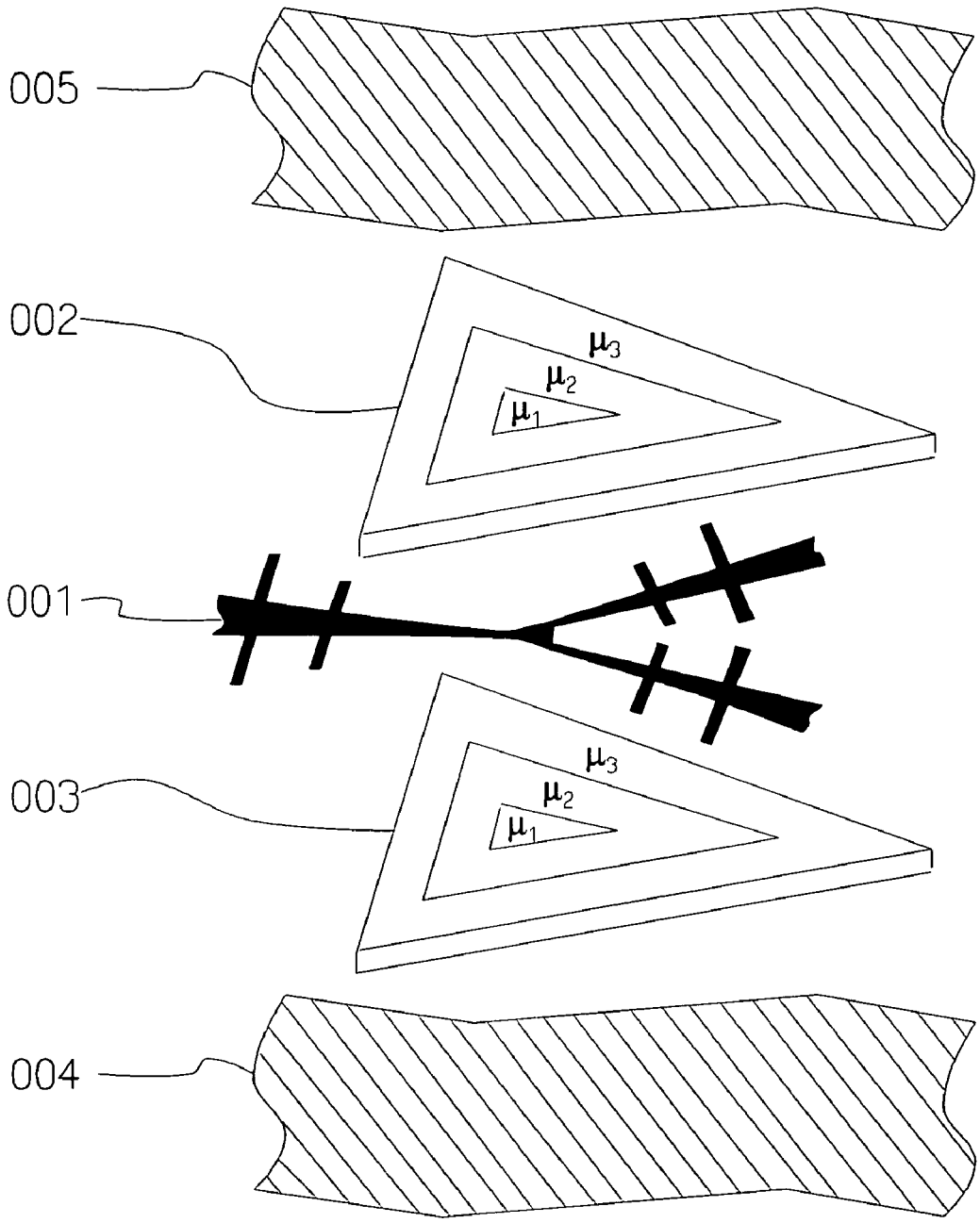
FIG. 8 shows another example of the preferred embodiment of the invention that the ferrite stripline circulator/isolator circuit consists of 3 joining ports sandwiched between composite ferrite superstrate and substrate assuming the triangular/strip geometry covered by ground planes at top and bottom; impedance transformers are also shown and the circuit is devised for the edge-mode operation.

FIG. 8 shows the other possibility that ferrites of different saturation magnetization are used in conjunction with a varying bias magnetic field. In FIG. 8 Superstrate 002 and Substrate 003 assume a composite structure consisting of triangularly/trapezoidally shaped ferrite blocks or strips with decreasing saturation magnetization, $\mu_1>\mu_2>\mu_3$; Central Conductor 001 is shown as a Y-branch with 3 joining ports and transformer stubs are included with the ports so as to match impedance differences for broadband operation. In comparison to FIG. 7 the varying saturation magnetization $\mu_1$, $\mu_2$, and $\mu_3$ shown with FIG. 8 have the advantage of generating a more fully magnetized magnetization profile over Superstrate 002 and Substrate 003 than if one ferrite material is used, say, $\mu_1$, which favors applications toward higher power ratings. However, the discontinuity in saturation magnetization $\mu_1$, $\mu_2$, and $\mu_3$ means the likelihood in generating MSWs thereby offsetting this power-rating advantage.

Figure 9:
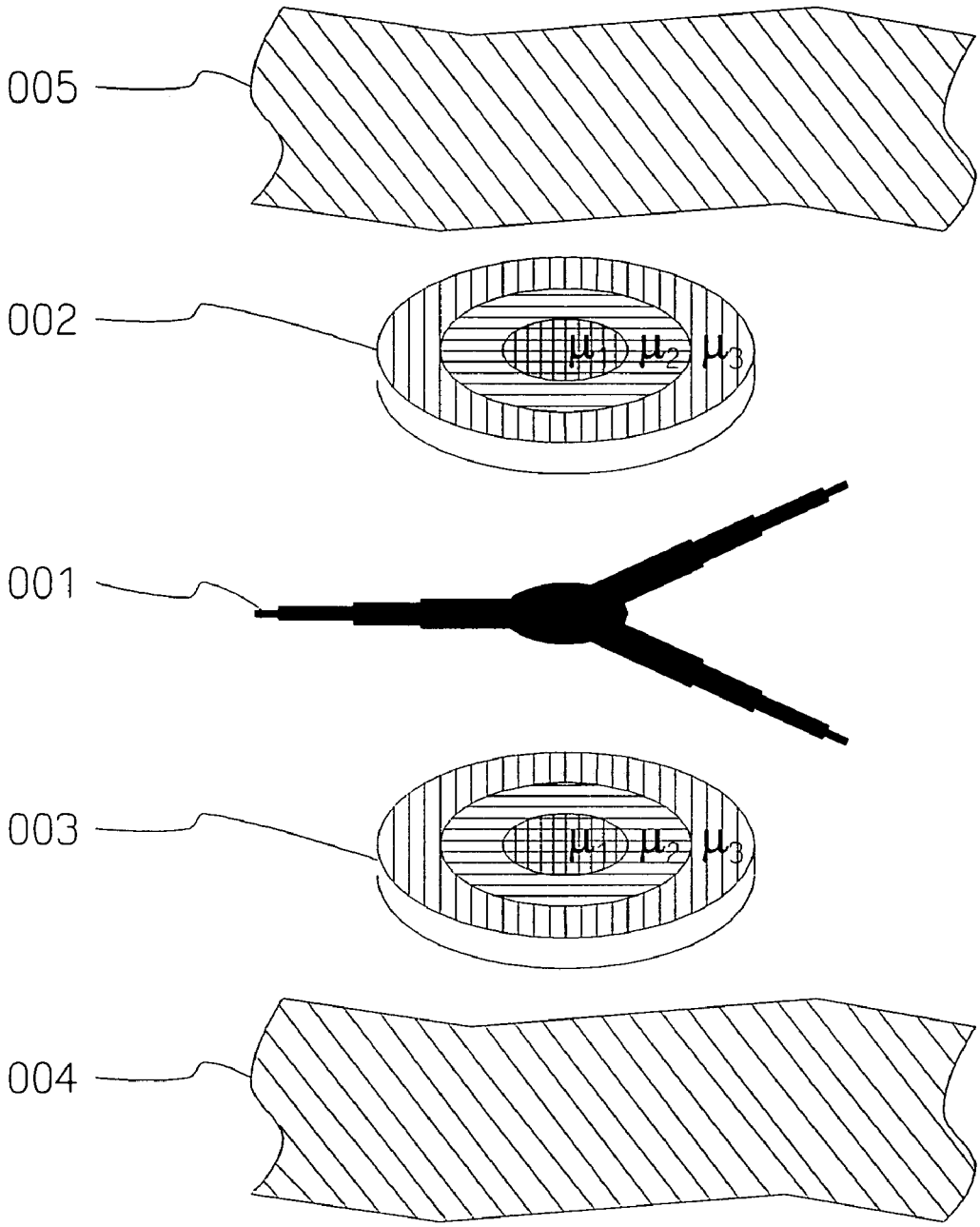
FIG. 9 shows another example of the preferred embodiment of the invention that the ferrite stripline circulator/isolator circuit consists of 3 joining ports sandwiched between composite ferrite superstrate and substrate assuming the disk/ring geometry covered by ground planes at top and bottom; impedance transformers are also shown and the circuit is devised for the edge-mode operation.

FIG. 9 shows the same composite ferrite structure of FIG. 8 except that the 3-fold symmetry assumed by FIG. 8 is replaced by the circular symmetry. The other difference between FIG. 8 and FIG. 9 is that transformer stubs are used by FIG. 8 and transformer sections are used by FIG. 9, same as those used by FIG. 7. Transformer section shown in FIG. 9 is able to matching a decreasing impedance difference, whereas those shown in FIG. 7 is to match an increasing impedance difference. In FIG. 7, FIG. 8, FIG. 9 the circulator operation launches edge modes in the ferrite materials, whereas in FIG. 10 resonant modes or standing modes are excited, reinforcing the frequency tracking condition thereby to insure the broadband circulation operation of a ferrite junction. In comparison to FIG. 9 the outermost ferrite ring, say, $\mu_3$, is replaced by a dielectric sleeve, $\epsilon$, or a transformer, capable of matching impedance difference occurring therein. Again, in FIG. 10 $\mu_1 > \mu_2$.

Further Illustration of the Present Invention:—FIG. 11, FIG. 12, FIG. 13

FIG. 11, FIG. 12, FIG. 13 show the calculated bias magnetic fields within the ferrite materials of a stripline circulator circuit. In FIG. 11 the bias field arises from 2 pieces of permanent magnets placed above and below the circulator circuit shown with FIG. 3, FIG. 4, FIG. 5, FIG. 6 and with FIG. 7, FIG. 8, FIG. 9, FIG. 10. In FIG. 11 normalized units are used for which the length is normalized with respect to the radius of the magnets and the magnetic field is in unit of the saturation magnetization of the magnets. In FIG. 11 the magnets are of radius 1, thickness 0.25, and the substrate/superstrate is of thickness 0.1. No flux shield is used in FIG. 11 and the ground planes are assumed of thickness 0. In FIG. 11 the solid curve shows the axial component of the resultant bias magnetic field, $B_z$, and the dashed curve shows the radial component of the bias field, $B_\rho$, both of which are calculated at the mid-plane positions of the ferrite materials. In FIG. 11 it is seen that without incorporating magnetic shaping, the resultant bias magnetic field has a profile far from desirable, not only because the axial component shows an increasing magnitude from center toward edge, but also significant radial component appear near the edge of the circulator active region. It is thus advantageous to incorporate magnetic shaping so as to entail the broadband operation, as discussed with FIG. 12 and FIG. 13 below.

FIG. 12 shows the calculated bias magnetic field when a pair of condenser caps are used. The condenser caps are assumed to have an infinite permeability; they assume the geometry of a truncated circular cone of thickness 0.25 and radii 1 and 0.5. Other parameters are the same as used with calculations of FIG. 1. The calculated axial and radial components of the bias field are shown as $B_z$ and $B_\rho$, respectively. In FIG. 12 it is seen that the axial component $B_z$ has been shaped into a more desirable profile, decreasing gradually from the center of the circulator circuit toward edge. However, the radial component $B_\rho$ still shows a bump at the edge of the circulator active region, which can be eliminated by adopting the other magnetic shaping configuration calculated with FIG. 13. In FIG. 13 partially cone-shaped magnets are used which are composed of two portions: the un-tapered portion is of a thickness 0.25 and the tapered portion is also of a thickness 0.25. In FIG. 13 flux shield has been employed, and the other parameters are the same as used with FIG. 11 and FIG. 12. In FIG. 13 it is seen that the axial component of the bias field, $B_z$, shows a desirable linear taping profile, and the radial component, $B_\rho$, has been almost totally eliminated. Preliminary measurement of a ferrite stripline circulator with the magnetic-shaping bias configuration shown with FIG. 13 has revealed a bandwidth broader than a 5:1 ratio with improved transmission characteristics; it outperforms the prior art significantly. In FIG. 12 and FIG. 13 linearly tapered condenser caps and magnets are used, respectively; other tapering geometries can also be equally used.

CONCLUSIONS

The present invention teaches a method and an apparatus enabling the bias magnetic field over the active region of a ferrite stripline circulator/isolator circuit to be properly shaped, showing a maximum axial component at the circuit center decreasing gradually toward edge. The radial component is also reduced. This allows the circulator/isolator circuit to result a broad bandwidth with improved transmission characteristics.

I claim:

1. A magnetic bias device to be used with a ferrite stripline circulator/isolator circuit, comprising:

a ferrite stripline and a predetermined means having a tapered structure to generate and shape the bias magnetic field to show a gradually decreasing axial component over the active region of said ferrite stripline circulator/isolator circuit thereby forming a nonuniform distribution profile over the active region, wherein by accommodating the change in said gradually decreasing axial component of said bias magnetic field with accompanying changes in magnetization over said active region of said ferrite stripline circulator/isolator circuit the requirement in frequency scaling over distance is satisfied thereby to result broadband operation with improved insertion loss and isolation.

2. The magnetic bias device of claim 1 wherein said ferrite stripline circulator/isolator circuit incorporates the propagation of edge modes or the excitation of standing modes.

3. The magnetic bias device of claim 1 wherein impedance transformers are included with said active region of said ferrite stripline circulator/isolator circuit.

4. The magnetic bias device of claim 1 wherein said predetermined means are also effective to minimize the radial component in the generation and shaping of said bias magnetic field.

5. The magnetic bias device of claim 1 wherein said ferrite stripline circulator/isolator circuit includes 2 or more ports.

6. The magnetic bias device of claim 1 wherein said ferrite stripline circulator/isolator circuit includes a substrate and a superstrate comprised of a uniform or a composite structure made up by ferrites of same or different saturation magnetization with or without a dielectric material or materials.

7. The magnetic bias device of claim 6 wherein said different saturation magnetization assumes a high value at the center, decreasing gradually toward the edge of said ferrite stripline circulator/isolator circuit.

8. The magnetic bias device of claim 1 wherein said predetermined means include the use of permanent magnets which are shaped individually or stacked together to form an assembly capable of generating said bias magnetic field to show said gradually decreasing axial component over said active region of said ferrite stripline circulator/isolator circuit.

9. The magnetic bias device of claim 8 wherein condenser caps and/or disks are used together with said permanent magnets to jointly generate and shape said bias magnetic field to show said gradually decreasing axial component over said active region of said ferrite stripline circulator/isolator circuit.

10. A method of obtaining improved performance of a ferrite stripline circulator/isolator circuit, comprising:

shaping the bias magnetic field with a tapered structure to show a gradually decreasing axial component over the active region of said ferrite stripline circulator/isolator circuit so as to create a nonuniform distribution profile over the active region, wherein by accommodating the change in said axial component of said bias magnetic field with accompanying changes in magnetization over said active region of said ferrite stripline circulator/isolator circuit the requirement in frequency scaling over distance is satisfied thereby to result broadband transmission with improved insertion loss and isolation.

11. The method of claim 10 wherein said ferrite stripline circulator/isolator circuit incorporates the propagation of edge modes or the excitation of standing modes.

12. The method of claim 10 wherein impedance transformers are included with said active region of said ferrite stripline circulator/isolator circuit.

13. The method of claim 10 wherein said ferrite stripline circulator/isolator circuit shows the 3-fold, the 6-fold, or the circular symmetry.

14. The method of claim 10 wherein said bias magnetic field is shaped to minimize the radial component.

15. The method of claim 10 wherein said ferrite stripline circulator/isolator circuit includes a substrate and a superstrate comprised of a uniform or a composite structure made up by ferrites of same or different saturation magnetization with or without a dielectric material or dielectric materials.

16. The method of claim 15 wherein said different saturation magnetization assumes a high value at the center, decreasing gradually toward the edge of said ferrite stripline circulator/isolator circuit.

17. The method of claim 10 wherein permanent magnets are used which are shaped or stacked into geometries capable of generating said bias magnetic field to show said gradually decreasing axial component over said active region of said ferrite stripline circulator/isolator circuit.

18. The method of claim 17 wherein condenser caps and/or disks are used together with said permanent magnets to jointly generate said bias magnetic field to show a gradually decreasing axial component over said active region of said ferrite stripline circulator/isolator circuit.

* * * * *